US010927586B2

(12) United States Patent
Schweiss

(10) Patent No.: US 10,927,586 B2
(45) Date of Patent: Feb. 23, 2021

(54) DOOR FLOOR ANCHOR ASSEMBLY

(71) Applicant: Michael L. Schweiss, Fairfax, MN (US)

(72) Inventor: Michael L. Schweiss, Fairfax, MN (US)

(73) Assignee: SORREL QUARTERS, LLC, Hector, MN (US)

( * ) Notice: Subject to any disclaimer, the term of this patent is extended or adjusted under 35 U.S.C. 154(b) by 446 days.

(21) Appl. No.: 15/995,737

(22) Filed: Jun. 1, 2018

(65) Prior Publication Data

US 2018/0371820 A1 Dec. 27, 2018

Related U.S. Application Data

(60) Division of application No. 15/290,627, filed on Oct. 11, 2016, now Pat. No. 10,184,285, which is a (Continued)

(51) Int. Cl.

| | |
|---|---|
| ***E05B 63/00*** | (2006.01) |
| ***E05F 15/605*** | (2015.01) |
| ***E05B 47/00*** | (2006.01) |
| ***E05B 65/00*** | (2006.01) |
| ***E06B 3/48*** | (2006.01) |
| ***E05D 15/26*** | (2006.01) |
| ***E05D 13/00*** | (2006.01) |
| ***E05B 53/00*** | (2006.01) |
| ***E05C 1/06*** | (2006.01) |

(Continued)

(52) U.S. Cl.

CPC ..... *E05F 15/605* (2015.01); *E05B 15/0046* (2013.01); *E05B 47/0012* (2013.01); *E05B 53/003* (2013.01); *E05B 65/0085* (2013.01); *E05C 1/06* (2013.01); *E05D 13/1207* (2013.01); *E05D 13/1223* (2013.01); *E05D 15/262* (2013.01); *E05D 15/264* (2013.01); *E06B 3/483* (2013.01); *E05B 2047/0036* (2013.01); *E05B 2063/0039* (2013.01); *E05F 15/67* (2015.01); *E05F 15/681* (2015.01); *E05Y 2201/43* (2013.01); *E05Y 2400/354* (2013.01); *E05Y 2600/46* (2013.01); *E05Y 2900/106* (2013.01); *E05Y 2900/108* (2013.01)

(58) Field of Classification Search

CPC ..... E05B 53/003; E05B 65/0085; E05C 1/06; E05F 15/681; E05F 15/684; E05F 15/686; Y10T 292/096; Y10T 292/1014; Y10T 292/0969; Y10T 292/097; Y10T 292/0992; Y10T 292/0997

USPC ..... 292/163, 164

See application file for complete search history.

(56) References Cited

U.S. PATENT DOCUMENTS 1,678,982 A * 7/1928 Griffin ..... E05C 1/08 292/171

3,024,838 A 3/1962 Egleston (Continued)

*Primary Examiner* — Daniel P Cahn

*Assistant Examiner* — Jeremy C Ramsey

(74) *Attorney, Agent, or Firm* — Richard John Bartz

(57) ABSTRACT

A bi-fold door is opened with a lift assembly having a plurality of straps attached to power driven lift drums. A latch assembly retains the closed bi-fold door secure to side columns of a building. The latch assembly has a latch strap attached to a latch drum that accommodates the latch strap to hold the closed bi-fold door in contact with the side columns of the building. A floor anchor assembly anchors the bottom of the closed bi-fold door to the floor below the closed bi-fold door to stabilize and inhibit bending and deformation of the bi-fold door frame.

14 Claims, 13 Drawing Sheets

Related U.S. Application Data continuation-in-part of application No. 15/067,431, filed on Mar. 11, 2016, now Pat. No. 10,053,901.

(60) Provisional application No. 62/193,706, filed on Jul. 17, 2015.

(51) Int. Cl.

| | |
|---|---|
| ***E05B 15/00*** | (2006.01) |
| *E05F 15/67* | (2015.01) |
| *E05F 15/681* | (2015.01) |

(56) References Cited

U.S. PATENT DOCUMENTS

| | | | | | |
|---|---|---|---|---|---|
| 3,708,917 | A | | 1/1973 | Streeter | |
| 4,026,343 | A | | 5/1977 | James | |
| 4,261,409 | A | | 4/1981 | Devore | |
| 4,637,446 | A | | 1/1987 | McQueen | |
| 4,739,584 | A | * | 4/1988 | Zellman | E05F 15/668 292/38 |
| 4,765,093 | A | | 8/1988 | Edwards | |
| 4,827,667 | A | * | 5/1989 | Jarvis | E05F 15/668 160/189 |
| 5,168,914 | A | | 12/1992 | Keller | |
| 5,343,923 | A | | 9/1994 | Keller | |
| 5,371,970 | A | * | 12/1994 | Ganikon | E05B 65/0021 160/189 |
| 5,560,658 | A | | 10/1996 | Coolman | |
| 6,199,617 | B1 | | 3/2001 | Schweiss | |
| 6,866,080 | B2 | | 3/2005 | Schweiss | |
| 7,219,711 | B2 | | 5/2007 | Keller et al. | |
| 2005/0199355 | A1 | | 9/2005 | Keller | |

* cited by examiner

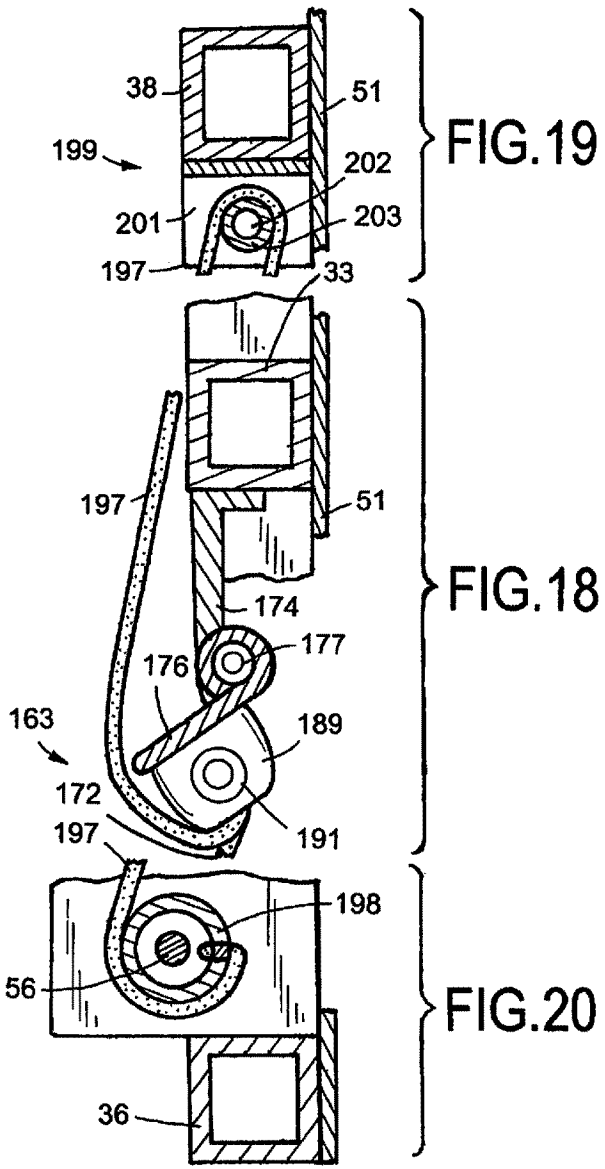
FIG.19
FIG.18
FIG.20
51
202
203
33
38
201
197
199
51
174
177
189
191
176
197
163
172
197
198
56
36
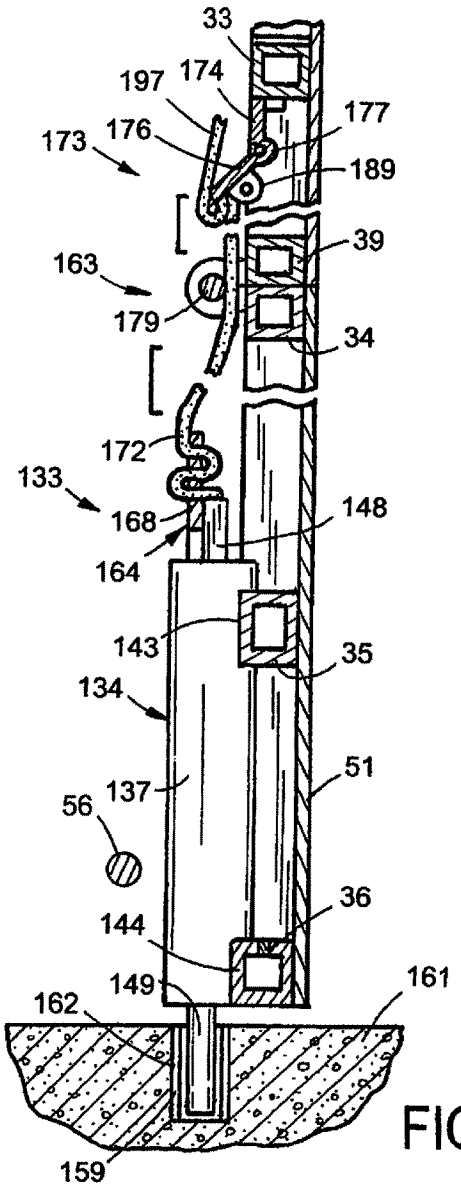
FIG.17
33
174
177
189
197
176
173
39
34
163
179
148
172
168
164
133
35
143
134
51
137
56
36
144
149
161
162
159

DOOR FLOOR ANCHOR ASSEMBLY

CROSS REFERENCE TO RELATED APPLICATION

This application is a division of U.S. patent application Ser. No. 15/290,627 filed Oct. 11, 2016. Application Ser. No. 15/290,627 is a continuation-in-part of U.S. patent application Ser. No. 15/067,431 filed Mar. 11, 2016. U.S. patent application Ser. No. 15/067,431 is a continuation of U.S. Provisional Patent Application Ser. No. 62/193,706 filed Jul. 17, 2015.

FIELD OF INVENTION

The latch assembly and floor anchor assembly for a bi-fold door is in the art of apparatus for and methods of holding a bi-fold door in an upright position and anchor the door to a floor to close a doorway in a building.

BACKGROUND OF THE INVENTION

Buildings have large openings or doorways for accommodating vehicles, aircraft, watercraft and equipment which are moved and out of the interior spaces in the buildings. Common types of conventional doors used to open and close the doorways are horizontally sliding doors and two piece center hinged doors known as bi-fold doors. An example of an overhead bi-fold door is disclosed by M. L. Schweiss in U.S. Pat. No. 6,866,080. The bi-fold doors have separate levers and mechanical latches operable to hold the doors in closed positions relative to the building structure.

F. F. Egleston et al. in U.S. Pat. No. 3,024,838 discloses a bi-fold door and keeper members mounted at the bottom of each of the columns adjacent the sides of the bi-fold door. The keepers include upright arms providing slots. Elements attached to lower side portions of the bi-fold door have rollers that engage the keeper arms to wedge the bi-fold door inwardly to keep the bi-fold door completely closed.

D. E. James in U.S. Pat. No. 4,026,343 discloses a bi-fold door having positive locking devices at the bottom of the door adopted to lock into floor notches to maintain the bi-fold door in a stationary upright closed position. As shown in FIG. 2, these latches mounted on the bottom of the bi-fold door have latch bolts that extend into notches in the floor below the bi-fold door. Springs bias the latch bolts into locking position into the floor notches. Triangular latch releases pivotally mounted on the bi-fold door are connected with cables. One latch release has a foot pedal which is depressed causing the latch bolts to be moved out of the floor notches thereby releasing latches and allowing the bi-fold door to be moved to an open position.

C. E. McQueen et al. in U.S. Pat. No. 4,637,446 discloses a latch member that engages a catch plate to lock a bi-fold door in an upright closed position. A spring connected to the latch member retains the latch member in locking engagement with the catch plate. A lift cable connected to the latch member extending to a door opening mechanism is used to release the latch member from the catch plate to allow the bi-fold door to swing to an open folded position.

C. P. Edward Jr. in U.S. Pat. No. 4,765,093 discloses an overhead tilt door having locking pins extended downwardly from the bottom of the door frame. When the door is closed, the pins extend into holes in the floor below the door. The locking pins when used with large doors increases the door's stability and resist forces caused by winds directed upon the large surface of the door when closed.

D. N. Keller in U.S. Pat. No. 5,343,923 discloses a latching assembly operable to hold a bi-fold door in an upright closed position. The latching assembly has an arm pivotally connected to the door frame that cooperates with a roller mounted on the adjacent door jamb. An actuation assembly driven by an electric motor operates to open and close the bi-fold door. The actuation assembly pulls a cable connected to the arm to pivot the arm into locking relationship with the roller on the door jamb to hold the bi-fold door in the upright closed position. The latching assembly operates with a single electric motor that performs the latching and unlatching operations automatically in cooperation with the opening and closing of the bi-fold door.

SUMMARY OF THE INVENTION

A combined cooperating apparatus is operable to open and close an opening or doorway of a structure with a bi-fold door for movement between a closed position and an open position relative to the opening in the structure. The apparatus comprises a door lift assembly operable to selectively open and close the bi-fold door. A door latch assembly is operable to latch the bi-fold door secure to side columns of the structure when the bi-fold door is in the closed position. A floor assembly anchor assembly is operable to anchor the closed bi-fold door to the floor or support below the closed bi-fold door. A reversible power transmission assembly operatively connected to the door lift assembly, the door latch assembly and the floor anchor assembly operates door lift assembly to selectively open and close the bi-fold door, operates door latch assembly to secure the bi-fold door to the side columns of the structure when the bi-fold door is in the closed position and operates the floor anchor assembly to anchor and release the anchor of the bi-fold door to and from the floor below the closed bi-fold door when the bi-fold door is in the closed position.

The latch assembly cooperates with the door lift assembly and a floor anchor assembly to secure a bi-fold door in an upright position closing a doorway of a building and anchor the bi-fold door to a floor. The bi-fold door has upper and lower panels hinged together to allow movement relative to each other between an upright closed position to a generally horizontal folded open position. The upper panel is hinged to a header attached to upright columns or door jambs. A door lift assembly comprising an electric motor driven shaft connect to lift drums accommodating flexible straps operates to move the door panels from upright closed positions to folded open positions to open the doorway to the interior of the building. Latch assemblies operatively connected to one of the panels of the bi-fold door have latch drums connected to the shaft and latch straps joined to the latch drums and adjacent columns hold the bi-fold door in the closed upright position. The door lift assembly straps wind on the lift drums and the latch straps unwind from the latch drums during movement of the bi-fold door from the upright closed position to the folded open position. During closing of the bi-fold door the latch straps wind on the latch drums and retain the door panels in upright closed positions in engagement with the adjacent doorway columns. The floor anchor assembly has an anchor drum mounted on the shaft accommodating an anchor strap. An anchor movably mounted on the bi-fold door is operatively connected to the anchor strap. The anchor is movable to an anchor first position on the floor below the closed bi-fold door and to an unanchor or release position from the floor when the bi-fold door is moved from the closed position to the open position. A biasing member associated with the anchor move the anchor to the anchor first position. The anchor strap wound on the anchor drum moves the anchor from the anchor first position to the unanchor second position relative to the floor below the bi-fold door.

DESCRIPTION OF THE DRAWING

FIG. 17 is an enlarged sectional view taken along line 17-17 of FIG. 3 showing the anchor pin of the floor anchor assembly in a lock position;

FIG. 18 is an enlarged sectional view taken along line 18-18 of FIG. 3;

FIG. 19 is an enlarged sectional view taken along line 19-19 of FIG. 3;

FIG. 20 is an enlarged sectional view taken along line 20-20 of FIG. 3;

DESCRIPTION OF THE BI-FOLD DOOR WITH LIFT MECHANISMS, LATCH ASSEMBLIES AND A FLOOR ANCHOR ASSEMBLY

In the following detailed description of the bi-fold door equipped with latch assemblies and floor anchor assembly, reference is made to the accompanying drawing that form a part hereof, and in which are shown, by way of illustration, specific embodiment in which the invention may be practiced. It is to be understood that other embodiments may be utilized and structure changes may be made or other method steps and sequence thereof may be used without departing from the scope of the present invention. The latch assembly and floor anchor assembly are herein described as used in building environment. The bi-fold door is described as having a single latch assembly and a single floor anchor assembly. Latch assemblies are mounted on opposite sides of the bi-fold door to secure both sides of the bi-fold door to the side columns of the structure. A plurality of floor anchor assemblies can be mounted on the bi-fold door to anchor the closed bi-fold door to the floor below the closed bi-fold door. The latch assembly and floor anchor assembly can have uses in other environments when securing doors used to close an opening is desired.

Figure 2:
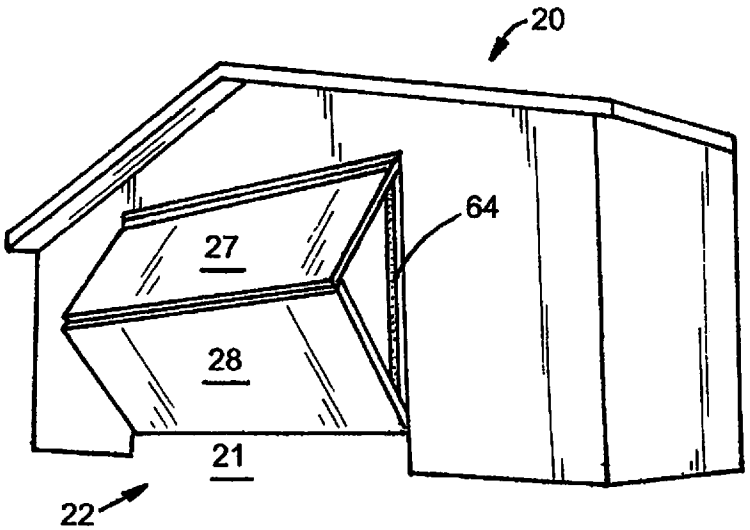
FIG. 2 is a perspective view of the bi-fold door of FIG. 1 in a partly open position.
Figure 1:
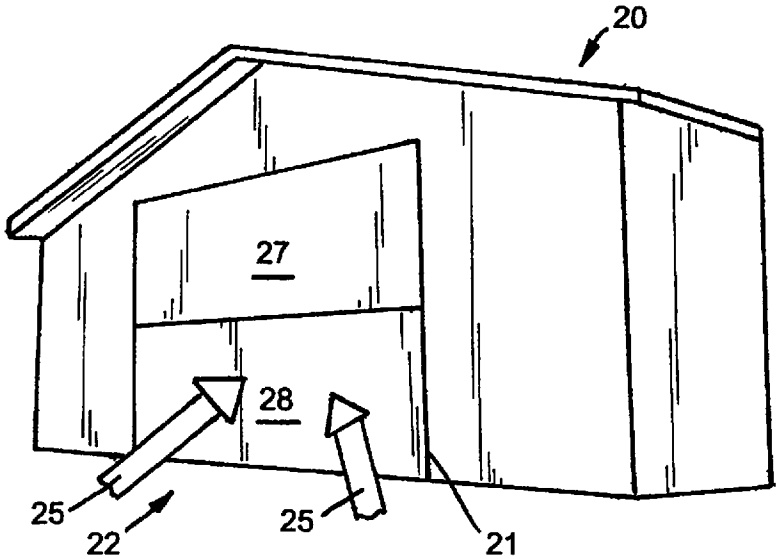
FIG. 1 is a perspective view of a bi-fold door closing a doorway of a building with a door lift assembly, a door latch assembly and floor anchor assembly.

A building 20, shown in FIGS. 1 and 2, has an opening or doorway 21 that is open and closed with a bi-fold door 22. Examples of building 20 include aviation hangers, automotive shops, farm shops, commercial buildings, warehouses and commercial plants. Building 20 has a horizontal header 23, shown in FIG. 3, attached to upright end columns 24 and 26 located around doorway 21 open to the interior of building 20. Bi-fold door 22 has an upper panel 27 and a lower panel 28 movable between upright aligned positions to close doorway 21. Panels 27 and 28 when located in the upright closed positions have large flat outside surfaces that are subjected to moving air or wind forces, shown by arrows 25. These wind forces are extreme in severe weather conditions, such as torrential rain, tornados and hurricanes. The latch assemblies in combination with one or more floor anchor assemblies provide the closed door with stability and inhibits bending and deformation of the door frame when subjected to wind forces. Panels 27 and 28 are moved with lift assemblies to folded horizontal positions to open doorway 21. Examples of bi-fold doors are disclosed in U.S. Pat. Nos. 4,637,446; 5,168,914; 6,199,617 and 6,866,080.

Bi-fold door 22 has a metal frame 29 supporting upper and lower panels 27 and 28. Upper panel frame has left and right upright side members 31 and 32 and a middle member 33 located between members 31 and 32. Top and bottom horizontal members 38 and 39 and upright middle members 41, 42, 43 and 44 are joined to members 38 and 39. Bottom panel 28 has top and bottom horizontal members 34 and 36 joined to end members 31 and 32. A horizontal frame member 35 located below frame member 37 is secured to frame members 31 and 32 and upright frame members 46, 47, 48 and 49. Frame members are elongated tubular beams welded to provide one-piece frames for panels 27 and 28. Sheathing 51 secured to frame 29 covers the outside of frame 29. A plurality of hinges 52 connected to frame members 39 and 34 pivotally join panels 27 and 28 for movement between an upright aligned closed position and a horizontal folded open position. A plurality of hinges 53 connected to top frame member 39 and header 23 pivotally mount door 22 on header 23 for swinging movement between an upright closed position and a generally horizontal folded open position.

Figure 3:
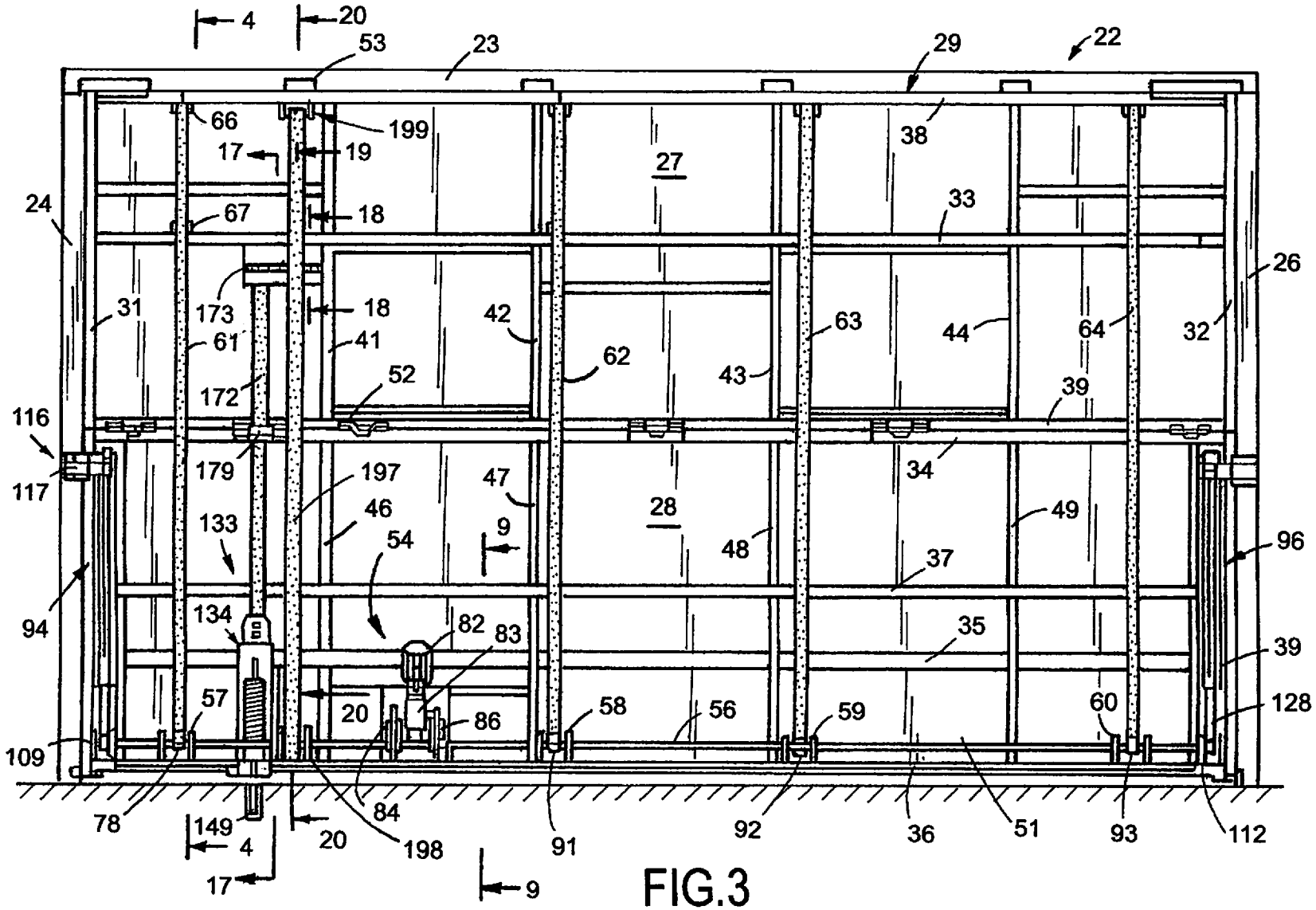
FIG. 3 is an inside elevational view of the bi-fold door of FIG. 1.
Figure 6:
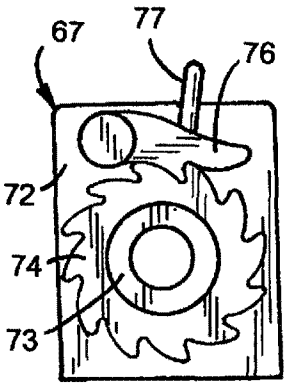
FIG. 6 is an end elevational view of the strap anchor for the door lift assembly.
Figure 7:
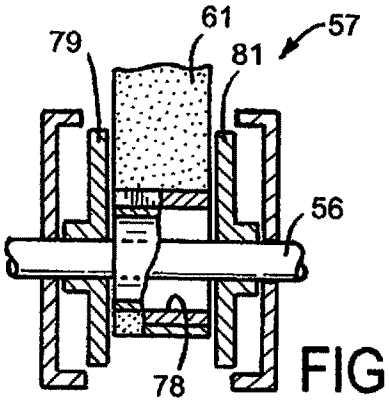
FIG. 7 is an enlarged sectional view of the lift drum accommodating a strap taken along the line 7-7 of FIG. 4.
Figure 5:
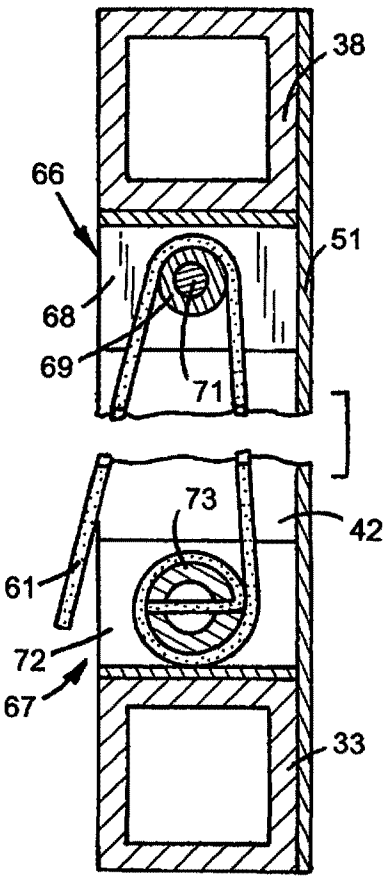
FIG. 5 is an enlarged foreshortened sectional view taken along line 5-5 of FIG. 4.
Figure 4:
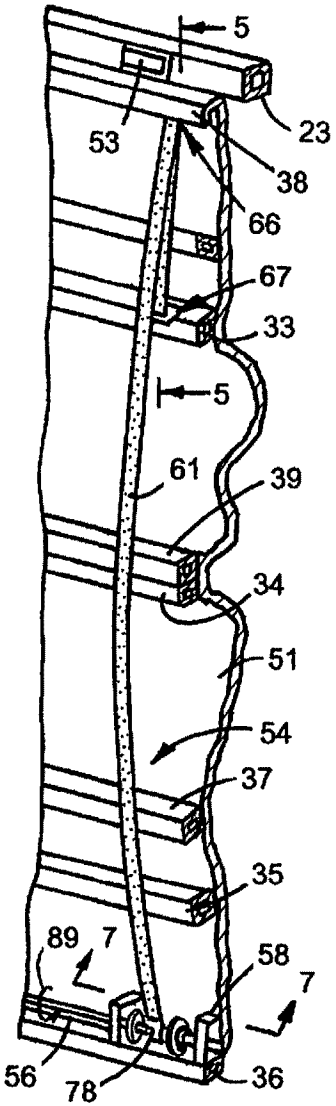
FIG. 4 is a perspective sectional view taken along line 4-4 of FIG. 3.
Figure 9:
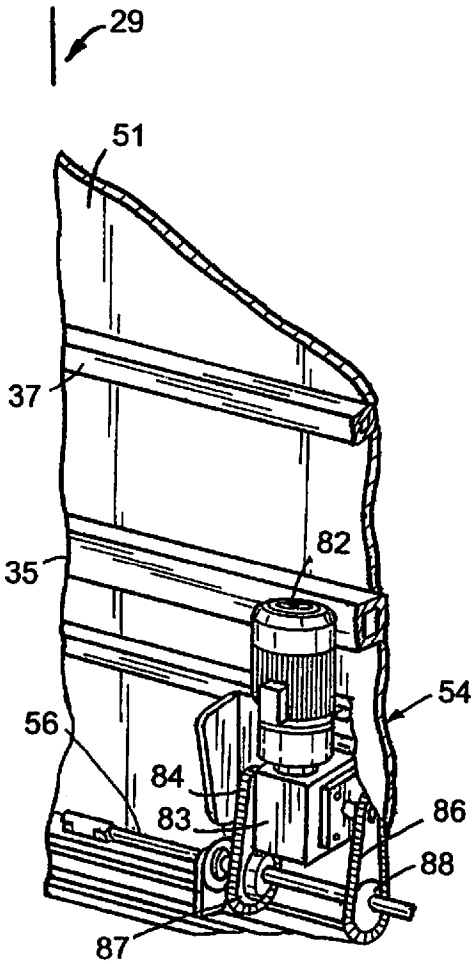
FIG. 9 is a perspective sectional view taken along line 9-9 of FIG. 3.

A door lift assembly 54 functions to lift door 22 from the upright closed position to the generally horizontal folded open position. Lift assembly 54 also retains door 22 in the open position. When lift assembly 54 releases door 22 the weight of door 22 returns door 22 to a nearly closed position. Automatic latch assemblies 94 and 96 hereinafter described move panels 27 and 28 in upright aligned positions closing doorway 21 and retaining opposite sides of panels 27 and 28 in engagement with columns 24 and 26. As shown in FIG. 3, door lift assembly 54 comprises a horizontal shaft 56 rotatably mounted on supports 57, 58, 59 and 60 secured to bottom member 36 of the lower panel frame. Supports 57, 58, 59 and 60 have bearings accommodating shaft 56 for rotation about a generally horizontal axis. A plurality of elongated flexible members, such as webs or straps 61, 62, 63 and 64 operatively connect shaft 56 to upper panel 27 whereby rotation of shaft 56 in one direction moves bi-fold door 22 from the closed position to the open position and releases the automatic latch assemblies 94 and 96 and rotation of shaft 56 in an opposite direction to the one direction allows bi-fold door 22 to move from the open position to the closed position and operating automatic latch assemblies 94 and 96 to retain panels 27 and 28 in upright aligned positions in secure engagement with columns 24 and 26 of building 20. As shown in FIG. 4, member 61 is an elongated flexible flat web or strap, such as a nylon or polyester web. The upper section of member 61 is trained over a support 66 secured to upper frame member 38 and terminating on an anchor member 67 secured to frame member 33. As shown in FIG. 5, support 66 has an inverted U-shaped bracket 68 secured with welds to the bottom of frame member 38. A roller or sleeve 69 is rotatably mounted on a bolt 71 attached to bracket 68. Strap 61 trained over roller 69 can move with roller 69 thereby reducing wear and strain on member 61. Ratchet anchor 67 has a U-shaped bracket 72 rotatably supporting a sleeve 73. Member 61 is wrapped around and secured to sleeve 73 to connect member 61 to sleeve 73 thereby anchoring member 61 to door frame 29. As shown in FIG. 6, the slack or tension of strap 61 is adjusted with a ratchet ring 74 secured to sleeve 73. A holding pawl 76 is held with a cotter pin 77 in engagement with the teeth on ring 74. Other devices can be used to adjust the slack or tension on strap 61. Flexible straps 62, 63, 64 are trained over rollers operatively connected to frame member 39 and anchored to frame member 33 according to member 61 as shown in FIGS. 4, 5 and 6. The lower end of member 61 is connected to lift drum 78 secured to shaft 56. As shown in FIG. 7, disks 79 and 81 attached to opposite ends of drum 78 maintain member 61 in wrapping relation around drum 78 during winding of strap 61 on drum 78 and unwinding of member 61 from drum 78. As shown in FIGS. 3 and 9, a reversible electric motor 82 drives a power transmission 83 operable to transmit power through chain drives 84 and 86 coupled to sprockets 87 and 88 to shaft 56 whereby shaft 56 is selectively rotated in opposite directions to move bi-fold door 22 to a folded open position and allow door 22 to move to a closed position. Shaft 56 is rotated in a counterclockwise direction, shown by arrow 89, to wind strap 61 around drum 78 to move door 22 to the open folded position. Lift drums 91, 92 and 93, shown in FIG. 3, secured to shaft 56 accommodates flexible straps 62, 63 and 64 and concurrently wind and unwind flexible straps 62, 63 and 64 on drums 91, 92 and 93 as flexible strap 61 winds and unwinds on drum 78. Limit switches (not shown) associated with electric motor 82 and transmission 83 control the duration or timing of the operation of electric motor 82.

Figure 8:
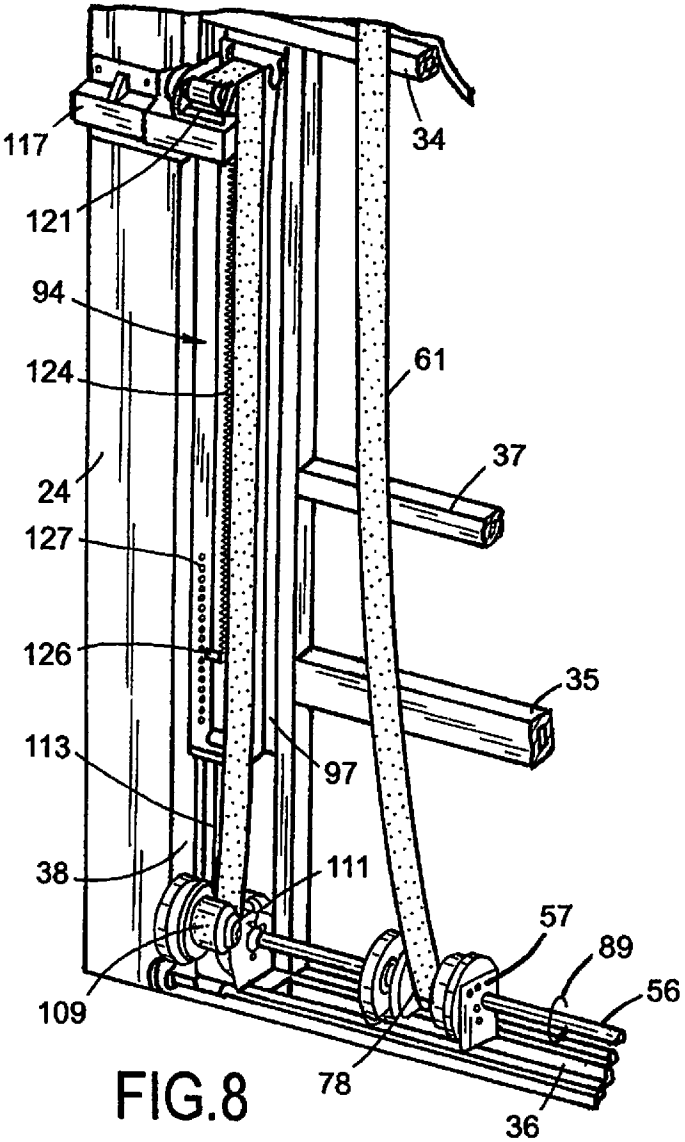
FIG. 8 is an enlarged sectional view of a section of the bi-fold door with a strap door lift assembly and a latch assembly.
Figure 12:
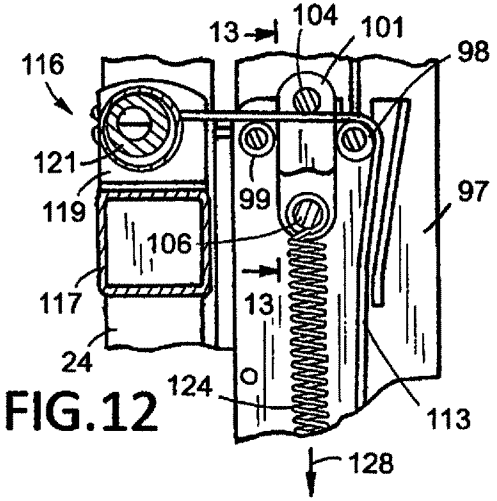
FIG. 12 is a partly sectioned side elevational view of the upper end of the latch assembly shown in FIGS. 10 and 11.
Figure 13:
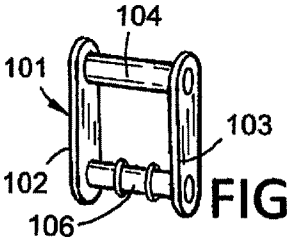
FIG. 13 is a sectional view taken along line 13-13 of FIG. 12.
Figure 14:
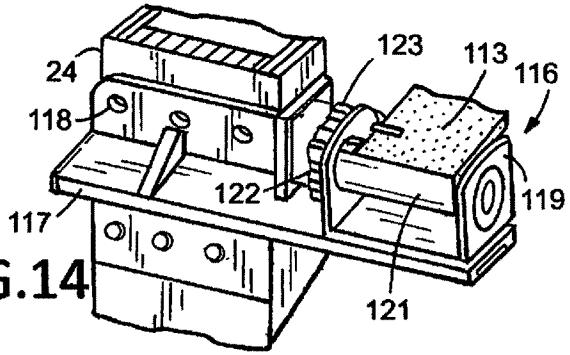
FIG. 14 is a perspective view of the latch assembly strap ratchet and bracket assembly.
Figure 11:
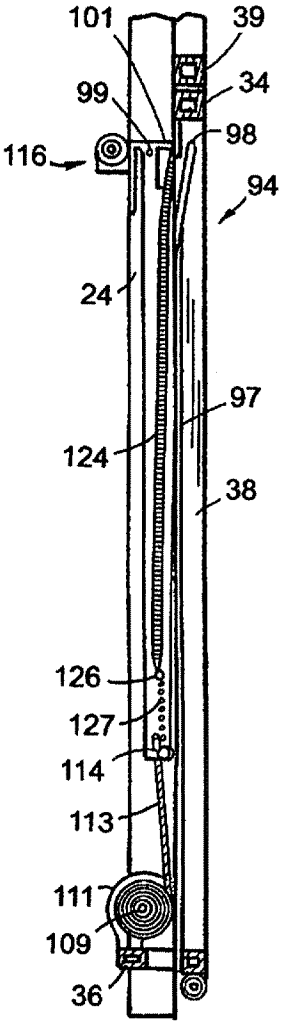
FIG. 11 is a sectional view taken along line 11-11 of FIG. 10.
Figure 10:
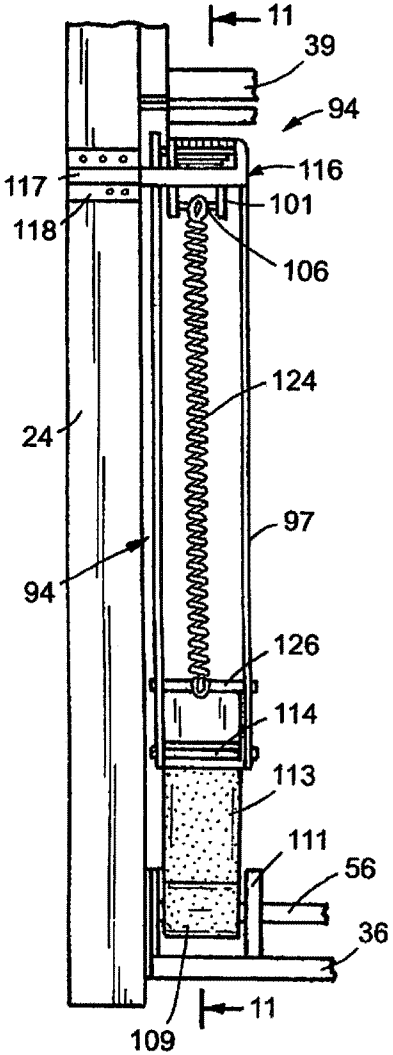
FIG. 10 is a partly sectioned front elevational view of a latch assembly for moving and holding the bi-fold door in the closed position.

Latch assemblies 94 and 96 mounted on opposite ends of frame 29 are operable to move panels 27 and 28 in upright or vertically aligned positions and retain panels 27 and 28 in secure engagement with columns 24 and 26 when door 22 is in the closed position. As shown in FIGS. 8, 10 and 11, latch assembly 94 secured to door fame 29 adjacent column 24 comprises an upright U-shaped frame 97. Frame 97 is fastened with welds to frame member 38 and adjacent frame members. Other types of fasteners can be used to attach frame 97 to door frame 29. As shown in FIGS. 12 and 13, a pair of horizontal rollers 98 and 99 are mounted on the upper end of frame 97. Rollers 98 and 99 are parallel and laterally spaced apart to accommodate a roller bracket assembly 101. Roller bracket assembly 101 has upright flat side members 102 and 103 connected to an upper pin or rod 104 and a lower pin or rod 106. A latch drum 109 located below frame 97 is rotatably mounted on supports 111 secured to door frame member 36. Shaft 56 is drivably connected to latch drum 109 to rotate latch drum 109 when driven by electric motor 82. Rotation of shaft 56 concurrently rotates lift drums 78, 91, 92 and 93 and latch drums 109 and 112 to move bi-fold door 22 to the upright closed position and retain bi-fold door 22 in the upright closed position. A latch strap 113 attached to latch drum 109 extends upward into U-shaped frame 97 between a roller 114 and back wall of frame 97. The upper section of strap 113 extends horizontally over rollers 98 and 99 to a strap anchor 116. As shown in FIG. 14, anchor 116 has a bracket 117 secured with fasteners 118 to column 24. A U-shaped support 119 secured to bracket 117 rotatably accommodates a sleeve 121. Strap 113 is secured to sleeve 121. Strap 113 is wound around sleeve 121 to adjust the effective length of strap 113 to retain bi-fold door 22 in the upright closed position. A ratchet wheel 122 secured to sleeve 121 is sued with a tool (not shown) to rotate sleeve 121 to wind strap 113 on sleeve 121. A pin 123 fixed to support 119 engages ratchet wheel 122 to hold ratchet wheel 122 and sleeve 121 in an adjusted position with strap 113 wound on sleeve 121. Returning to FIGS. 10 and 11, a tension spring 124 has a lower end connected to a bolt 126 extended through holes 127 in latch frame 97. Latch frame 97 has a plurality of vertically arranged holes 127 accommodating bolt 126 for adjusting the biasing force of spring 124 on strap 113, shown by arrow 128 in FIG. 12. The upper end of spring 124 is connected to pin 106 of roller bracket assembly 101. Pin 104 located on top of strap 113 between rollers 98 and 99 applies the biasing force of spring 124 to pull strap 113 down between rollers 98 and 99 to take up slack of strap 113 and maintain the tension on strap 113 during the opening and closing of bi-fold door 22.

Figure 15:
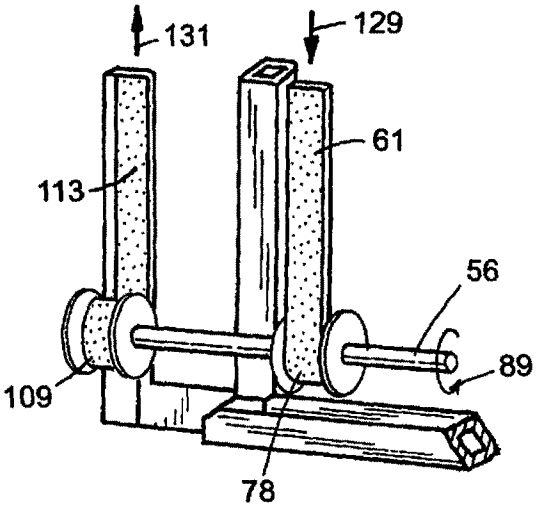
FIG. 15 is a perspective view of the strap lift drum and strap latch drum connected to the drive shaft of the door lift assembly.
Figure 16:
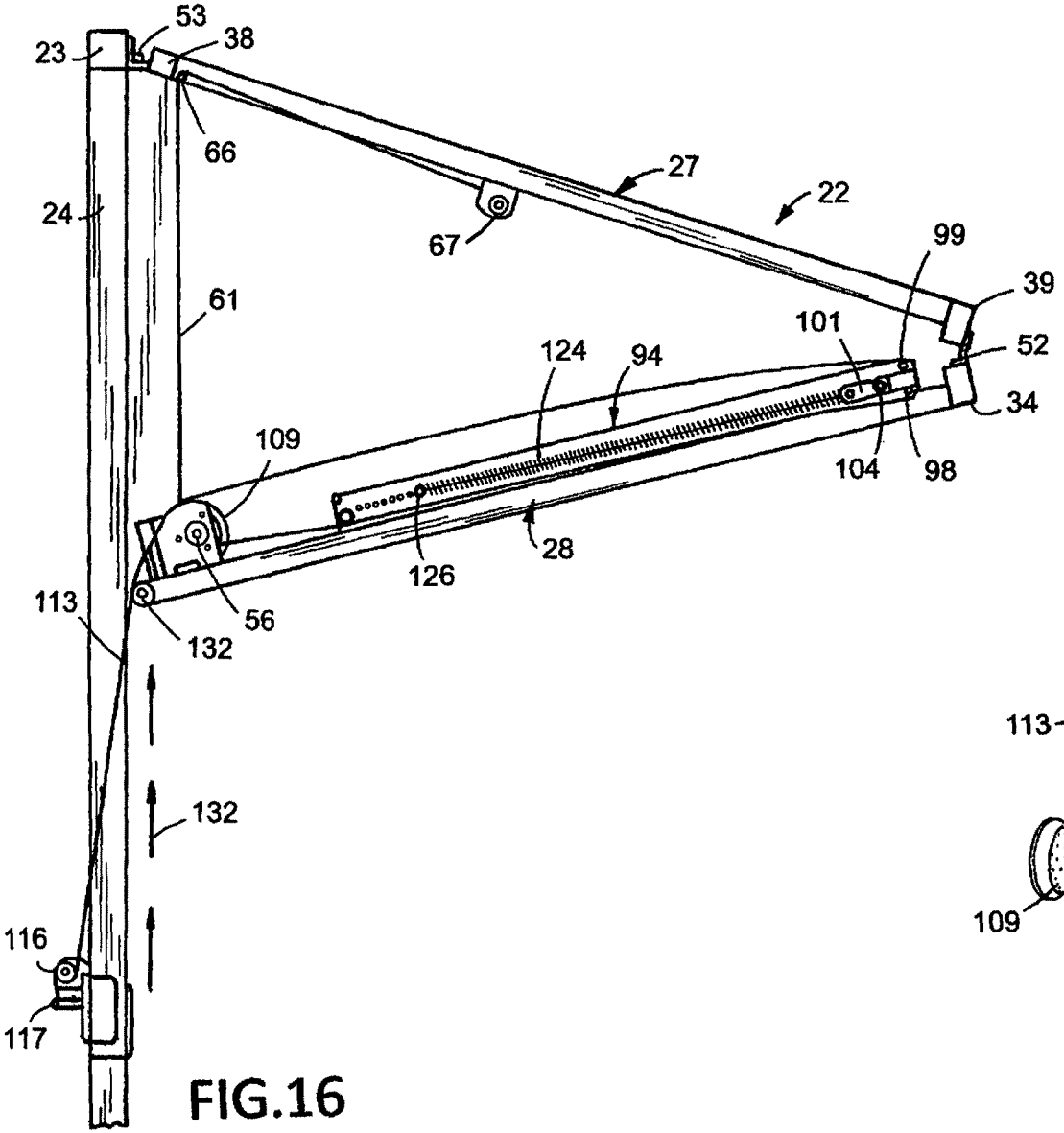
FIG. 16 is a side elevational view showing the bi-fold door in a partly open position.

Latch assembly 96 mounted on the right end of door 22, as shown in FIG. 3, has the same structure and operation as latch assembly 96. Shaft 56 is drivably connected to latch drum 112 to rotate latch drum 112 whereby strap 128 is wound on and unwound from latch drum 112 during the opening and closing of bi-fold door 22 and the latching and unlatching functions of latch assembly 96. As shown in FIG. 15, when shaft 56 is rotated counterclockwise, shown by arrow 89, strap 61 is wound on lift drum 78. Straps 62, 63 and 64 are also wound on drums 91, 92 and 93. The combined straps 61, 62, 63 an 64 move down, shown by arrow 129, thereby moving bi-fold door 22 from the closed position to the folded open position. During counterclockwise rotation of shaft 56 latch drum 109 unwinds strap 113 from latch drum 109 whereby strap 113 moves upward releasing the horizontal force holding bi-fold door 22 in the closed position and allowing the bi-fold door to move upwardly to the open position, as shown by arrows 132 in FIG. 16. Strap 113 rides on roller 132 on the bottom of frame member 36 during movement of bi-fold door 22 between open and closed positions. Spring 124 connected to roller bracket assembly 101 maintains a continuous biasing force on strap 113 during the opening and closing of bi-fold door 22. Shaft 56 is rotated in a clockwise direction by reversing the drive of electric motor 82. Straps 61, 62, 63 and 64 unwind from lift drums 78, 91, 92 and 93 allowing bi-fold door 22 to unfold from the open position to an upright closed position. The weight of bi-fold door 22 caused bi-fold door 22 to move down as straps 61-64 unwind from their respective lift drums. Strap 113 as it winds onto latch drum 109 pulls bi-fold door 22 to an upright closed position against columns 24 and 26. When bi-fold door 22 is in the closed position, spring 124 acting on strap 113 biases bi-fold door 22 against column 24 and maintains bi-fold door 22 in the upright closed position.

Figure 27:
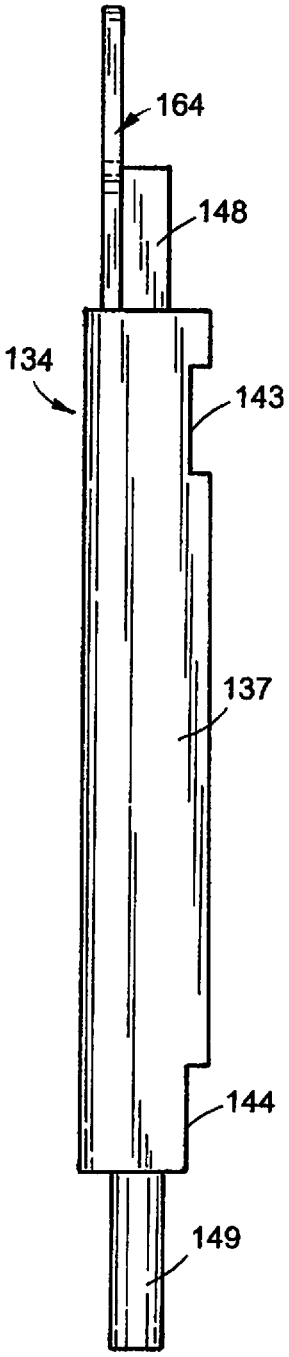
FIG. 27 is a left side elevational view of FIG. 25.
Figure 28:
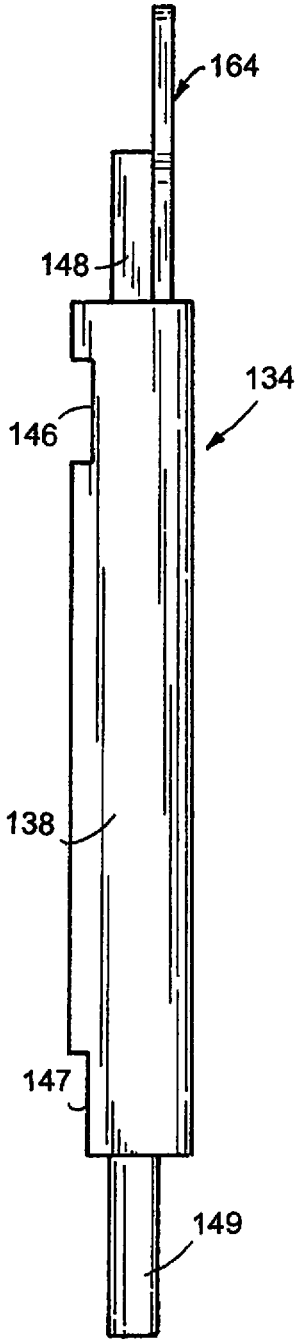
FIG. 28 is a right side elevational view of FIG. 25.

A floor anchor assembly 133, shown in FIGS. 3 and 17, secured to door frame 29, holds the bottom of door 22 in its closed position in an anchor or fixed position on the floor or support below the door. A plurality of floor anchor assemblies can be secured to door frame 29 to hold bi-fold door on the floor below the closed bi-fold door 22. Floor anchor assembly 133 has a body or housing 134 mounted on door frame members 35 and 36. Housing 134 is a metal U-shaped member having a front wall 136 joined to side walls 137 and 138. Front wall 136 has a rectangular opening 139 and top and bottom vertical slots 141 and 142 open to opening 139. As shown in FIGS. 27 and 28, side wall 137 has top and bottom rectangular recesses 143 and 144 aligned with top and bottom rectangular recesses 146 and 147 in side wall 138. Housing 134 is mounted on frame members 35 and 36, shown in FIG. 17, with frame member 35 located in top recesses 143 and 146 and frame member 36 located in bottom recesses 144 and 147. Welds secure side walls 137 and 138 to frame members 35 and 36.

Figure 29:
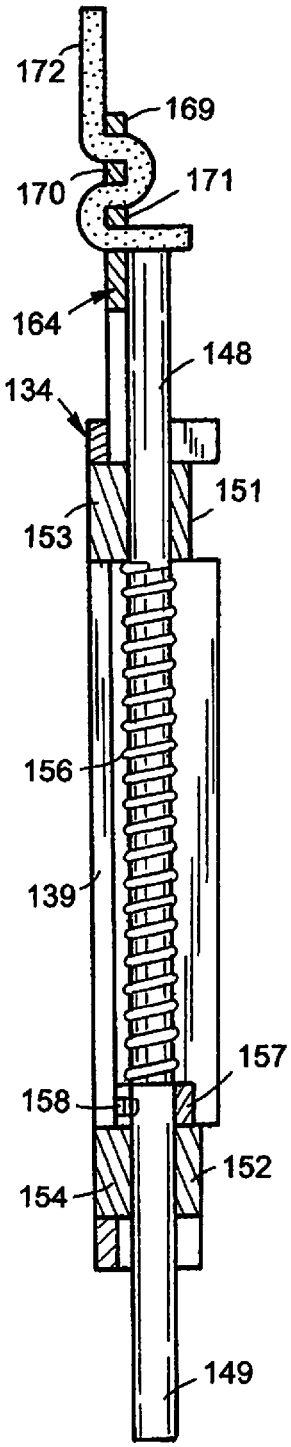
FIG. 29 is a sectional view taken along line 29-29 of FIG. 26.
Figure 30:
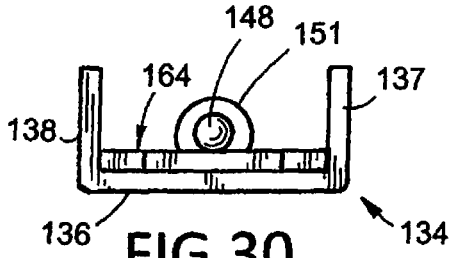
FIG. 30 is a top plan view of FIG. 26.
Figure 31:
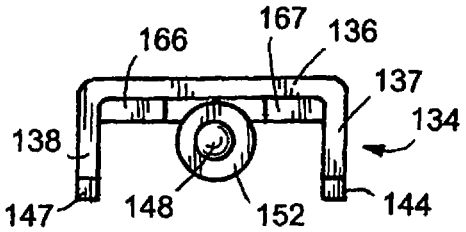
FIG. 31 is a bottom plan view of FIG. 26.
Figure 32:
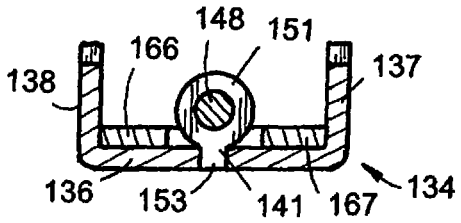
FIG. 32 is a sectional view taken along line 32-32 of FIG. 25.
Figure 33:
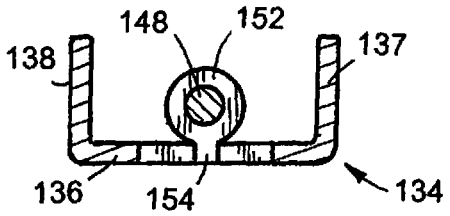
FIG. 33 is a sectional view taken along line 33-33 of FIG. 25.

As shown in FIG. 29, an upright pin or rod 148 extends through sleeves 151 and 152. Rod 148 is an anchor that operates to retain the bi-fold door 22 in a fixed or stationery position relative to the floor below bi-fold door 22. Rod 148 has a lower end 149 that projects downward from the lower end of housing 134. Sleeve 151 has an upright rib 153 located in slot 141. Sleeve 152 has an upright rib 154 located in slot 142. Welds secure ribs 153 and 154 to front wall 136 of housing 134 to secure sleeves 151 and 152 to housing 134. Sleeves 151 and 152 are support members for rod 148 and allow rod 148 to move between up and down positions relative to housing 134. A coil spring 156, shown in FIGS. 25, 26, 29 and 34, is trained around rod 148 between sleeves 151 and 152. The upper end of spring 156 engages sleeve 141. The lower end of spring 156 engages a collar 157 located around rod 148. A set screw 158 secures collar 157 to rod 148. Spring 156 is a biasing member that retains rod 148 in its down floor anchor position. Collar 157, shown in FIG. 29, contacts sleeve 152 whereby sleeve 152 functions as a stop to limit downward movement of rod 148. The location of collar 157 along the length of rod 148 is adjustable to vary the down floor anchor position of rod end 149.

Returning to FIGS. 17 and 26, the lower end 149 of rod 158 is located in a cavity or hole 159 in floor 161 located below the closed door 22. An upright metal tube 162 embedded or fixed into floor 161 surrounds hole 159. Other structures can be used to lock rod 158 to the floor 161. Floor 161 is a stationary support comprising concrete, asphalt, wood and like materials. When rod end 149 is located in hole 159 door is laterally stabilized and door frame 29 is inhibited from bending and deforming when subjected to wind and load forces.

Figure 25:
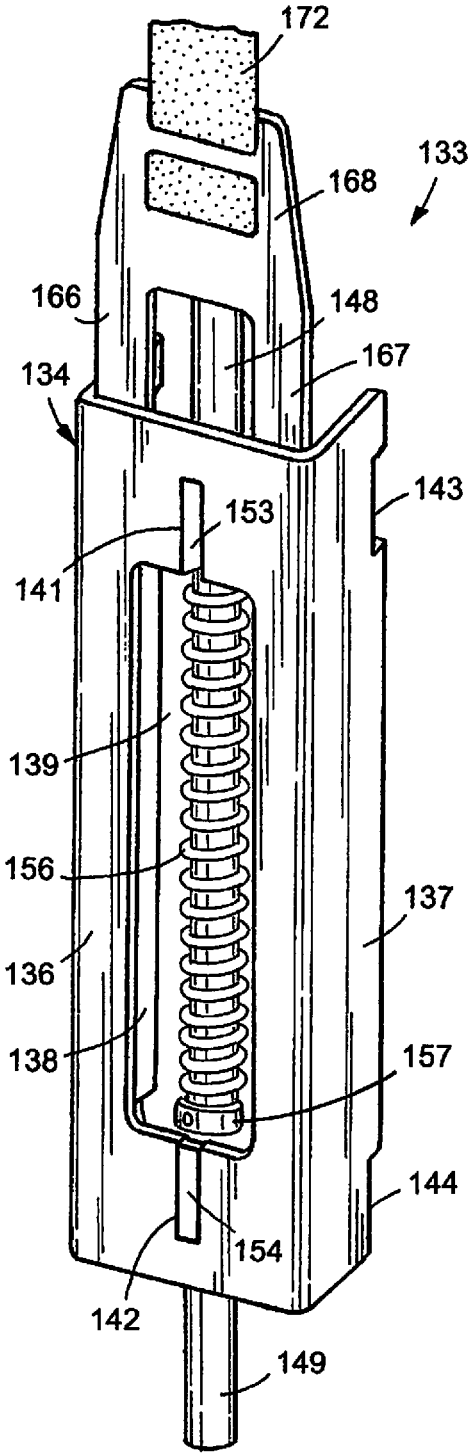
FIG. 25 is an enlarged perspective view of the floor anchor assembly shown in FIGS. 3 and 17.
Figure 26:
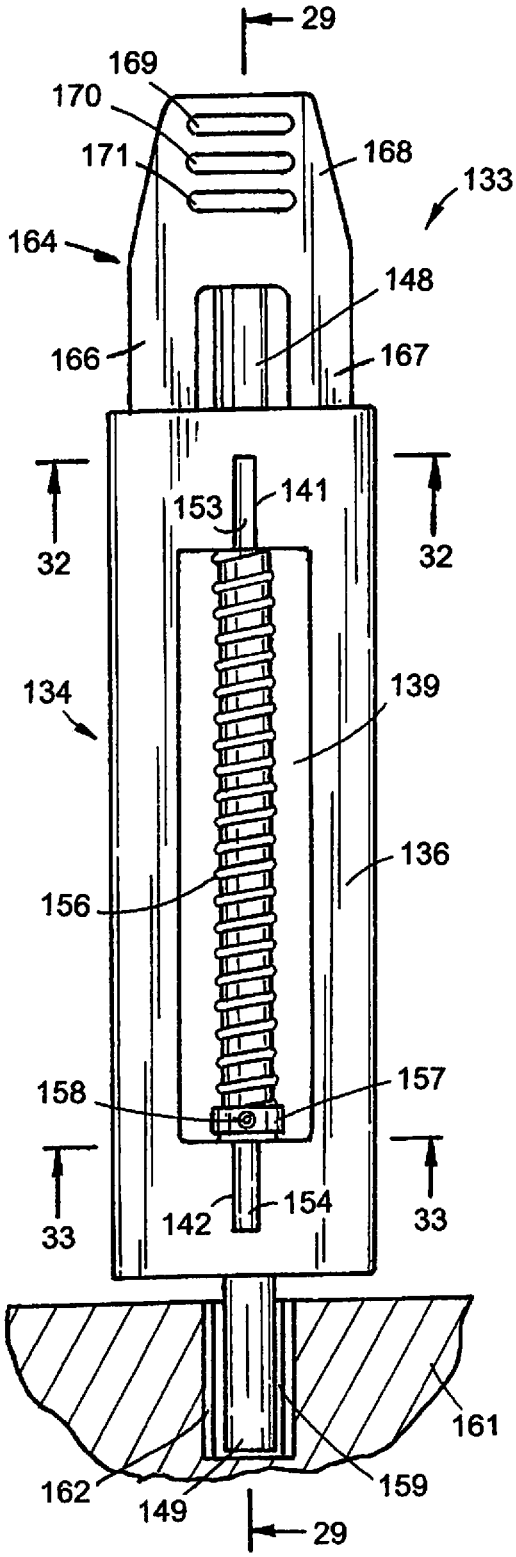
FIG. 26 is a front elevational view of FIG. 24.
Figure 34:
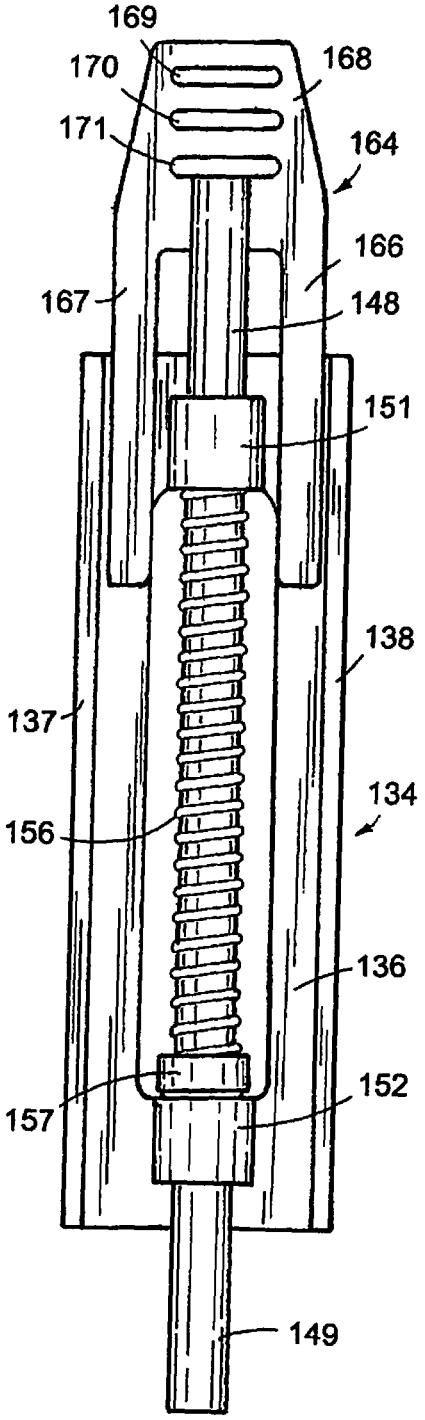
FIG. 34 is a back elevational view of FIG. 25.

Rod 148 is moved upward to withdraw rod end 149 from hole 159 in floor 161 to allow door 22 to be moved from the closed position to the open position. An anchor release assembly 163 operatively connected to rod 148 and shaft 56 moves rod 148 to an unlock position out of hole 159 in response to operation of door lift mechanism 54. Assembly 163 comprises an inverted U-shaped member or yoke 164. As shown in FIG. 34 yoke 164 has a pair of legs 166 and 167 that extend downward into housing 134 adjacent opposite sides of sleeve 151. The upper ends of legs 166 and 167 are joined to a body 168 having three spaced horizontal openings or slots 169, 170 and 171. The upper end of rod 148 is secured with welds to body 168 whereby rod 148 and yoke 164 concurrently move relative to housing 134 to floor anchor and unanchor positions. A flexible flat strap 172 connects body 168 of yoke 164 to a motion transmission mechanism 173. Strap 172 is threaded through slots 169, 170 and 171, as shown in FIGS. 17, 25 and 29 to secure strap 172 to body 168 of yoke 164.

Figure 22:
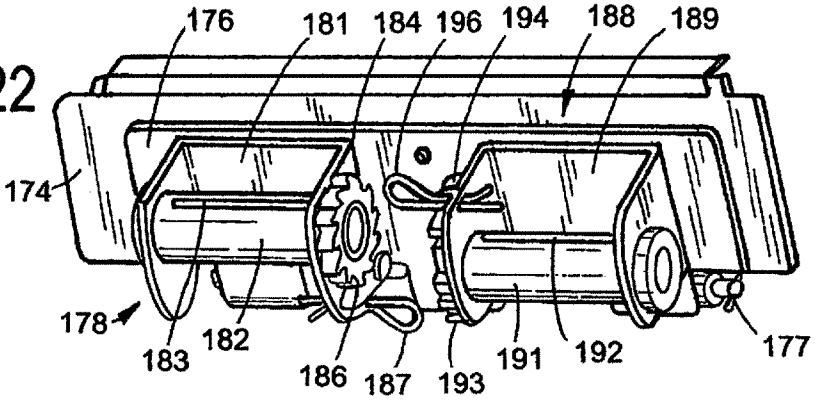
FIG. 22 is a bottom perspective view of the double strap anchor assembly of FIG. 20.
Figure 23:
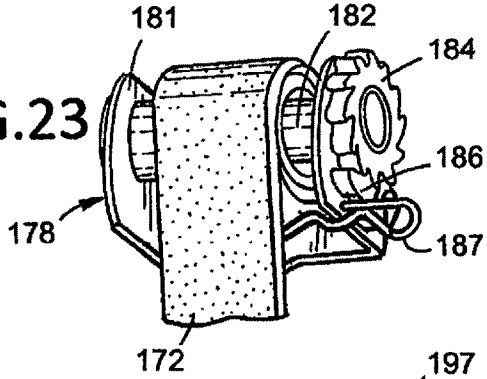
FIG. 23 is a perspective view of the door anchor strap ratchet and strap of the double strap anchor assembly.
Figure 21:
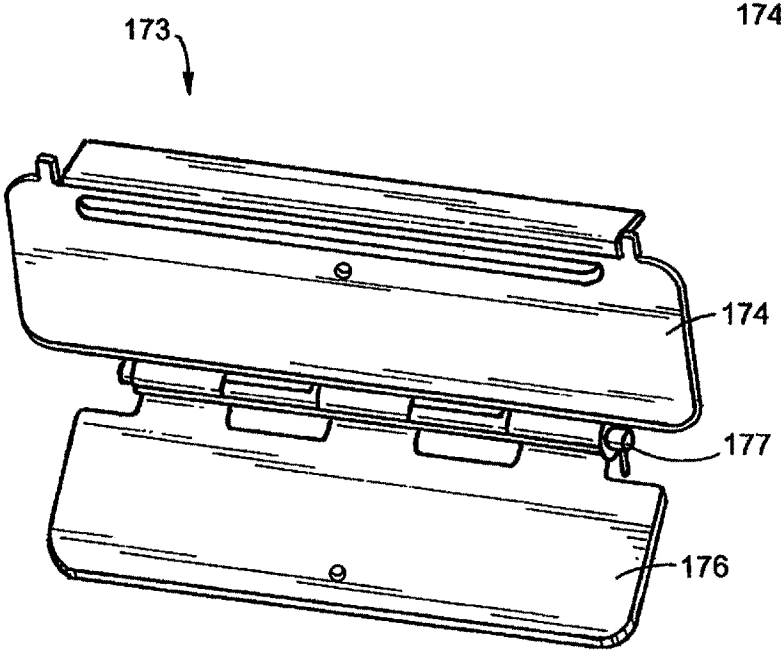
FIG. 21 is a perspective view of the double strap anchor assembly.
Figure 35:
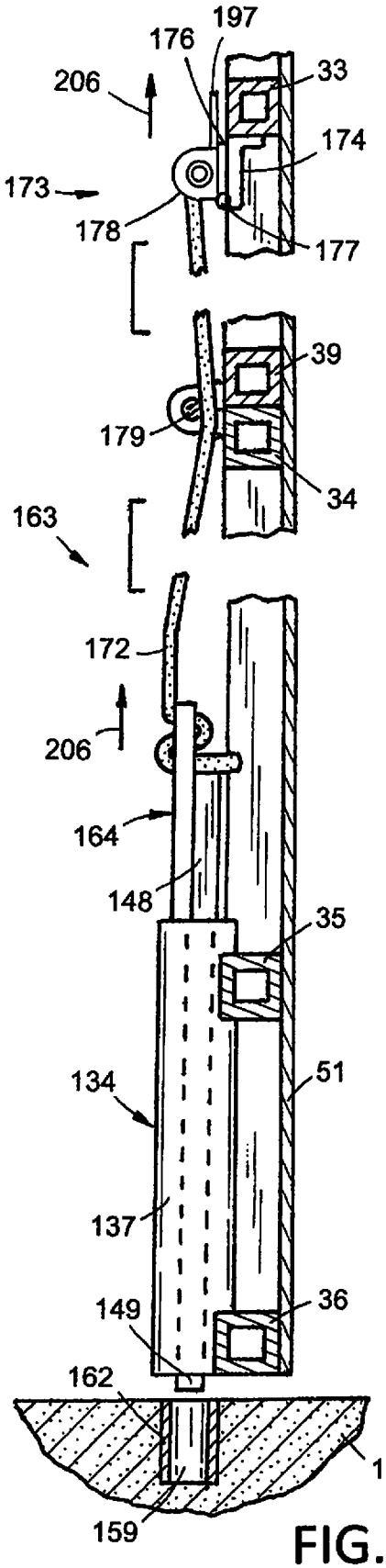
FIG. 35 is a sectional view corresponding to FIG. 17 showing the anchor rod in an unlock position.
Figure 36:
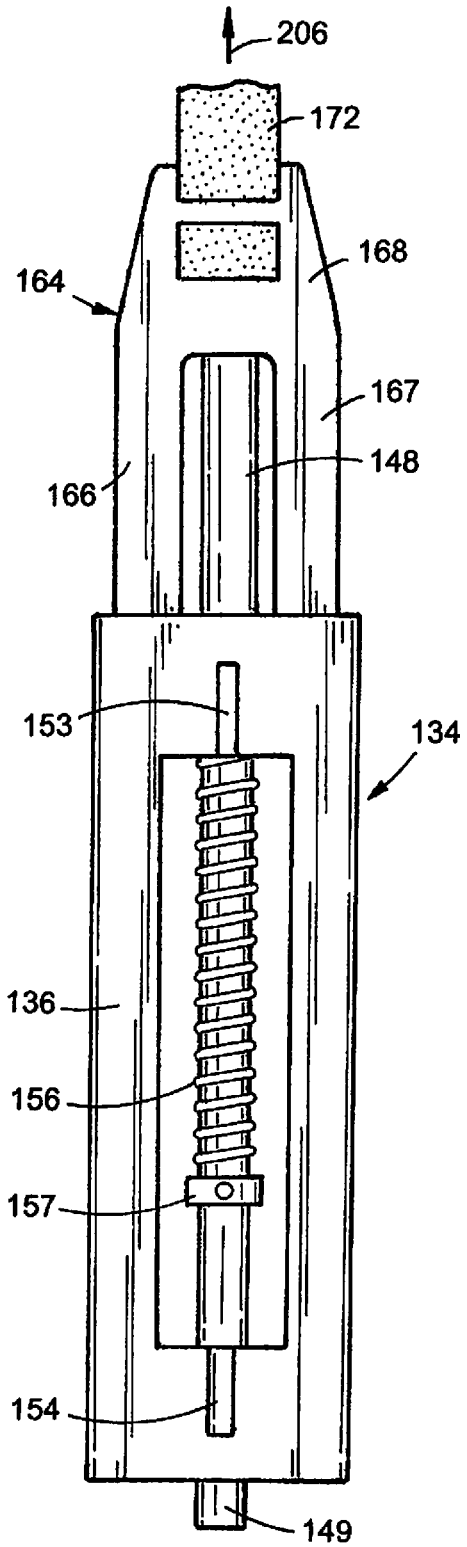
FIG. 36 is an enlarged front elevational view of the floor anchor assembly of FIG. 35.

Motion transmission mechanism 173 secured to frame member 33 comprises a first plate 174 having a top section attached with a weld to frame member 33. A second plate 176 located below first plate 174 is pivotally connected with a hinge 177 to first plate 174 for movement between an open first position, shown in FIGS. 17, 18 and 21, and a closed position, shown in FIGS. 22 and 35. A first ratchet strap anchor 178 is mounted on second plate 176. Strap 172 extends upward under hinge pin 179 to ratchet strap anchor 178. Strap anchor 178, shown in FIGS. 22 and 23, comprises a U-shaped member 181 secured to second plate 176. A sleeve 182 with an elongated slot 183 is rotatably mounted on U-shaped member 181. Strap 172 has an end extended into slot 183 to attach strap 172 to sleeve 182 whereby strap 172 is wrapped around sleeve 182 to adjust the effective working length of strap 172 between yoke 164 and first ratchet strap anchor 178. A ratchet wheel 184 secured to an end of sleeve 182 cooperates with a pawl 186 to retain sleeve 182 and strap 172 in adjusted positions. A tool (not shown) is used to turn ratchet wheel 184 to wind strap 172 onto sleeve 182 to adjust the effective working length of strap 172. A cotter pin 187 extended through a hole in the U-shaped member 181 contracts pawl 186 to hold pawl 186 in locking engagement with ratchet wheel 184 thereby maintaining the effective working length of strap 172 between yoke 164 and first ratchet strap anchor 178. As shown in FIGS. 17 and 18, when motion transmission mechanism 163 is in the open or first position strap 172 do not exert a pulling force on yoke 164 whereby spring 156 biases rod 148 down to locate the lower end 149 of rod 148 in hole 159 in floor 161 whereby floor anchor assembly 133 inhibits lateral and transverse movements of closed door 22 when subjected to moving air, rain and snow forces.

Figure 24:
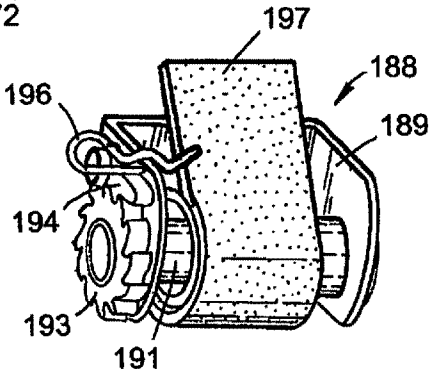
FIG. 24 is a perspective view of the door lift strap ratchet and strap of the double strap anchor assembly.

Returning to FIGS. 22 and 24, a second strap anchor 188 is attached to plate 176 adjacent first strap anchor 178. Second strap anchor 188 have U-shaped member or bracket 189 secured with a weld to plate 176. A sleeve 191 with a slot 192 is rotatably mounted on U-shaped member 189. A lift strap 197 has an end extended through slot 192 to attach strap 197 to sleeve 191 whereby strap 197 is wrapped around sleeve 191. A ratchet wheel 193 secured to an end of sleeve 191 is used to rotate sleeve 191 and retain sleeve 191 and strap 197 in adjusted positions. Strap 197 is adjusted to have an effective working length between motion transmission mechanism 173 and door lift drum 198 secured to shaft 56. A pawl 194 mounted on U-shaped member 189 engages ratchet wheel 193 to retain sleeve 191 and strap 197 in adjusted positions. A tool (not shown) is used to turn ratchet wheel 193 to wind strap 197 onto sleeve 191 to adjust the working length of strap 197. A cotter pin 196 extended through a hole in U-shaped member 189 engages pawl 194 to hold pawl 194 in a locked position on ratchet wheel 193 thereby maintaining the effective working length of strap 197.

As shown in FIG. 19, an anchor member 199 is attached to door frame member 38 for the upper section of lift strap 197. Anchor member 199 comprises a U-shaped bracket 201 welded to the bottom of frame member 38. Bracket 201 accommodates a horizontal pin 202. A tubular member or sleeve 203 is rotatably located on pin 202. Strap 197 trained over sleeve 202 extend downward to lift drum 198. The lower end of strap 197 is connected to lift drum 198 as shown in FIG. 20. Lift drum 198 is secured to shaft 56.

In use electric motor 82 operates to transmit power to shaft 56 whereby lift drums 57, 58, 59 and 60 along with lift drum 198 rotate in a first direction to together move door 22 from a closed upright position to a folded open position adjacent header 23. Shaft 56 when rotated in a second direction opposite the first direction allows the bi-fold door 22 to move from the open folded position to the closed position and rotates latch drum 109 to wind latch strap 113 on the latch drum 109 whereby latch strap 113 holds the sides of bi-fold door 22 in firm contact or engagement with the adjacent doorway columns.

Figure 37:
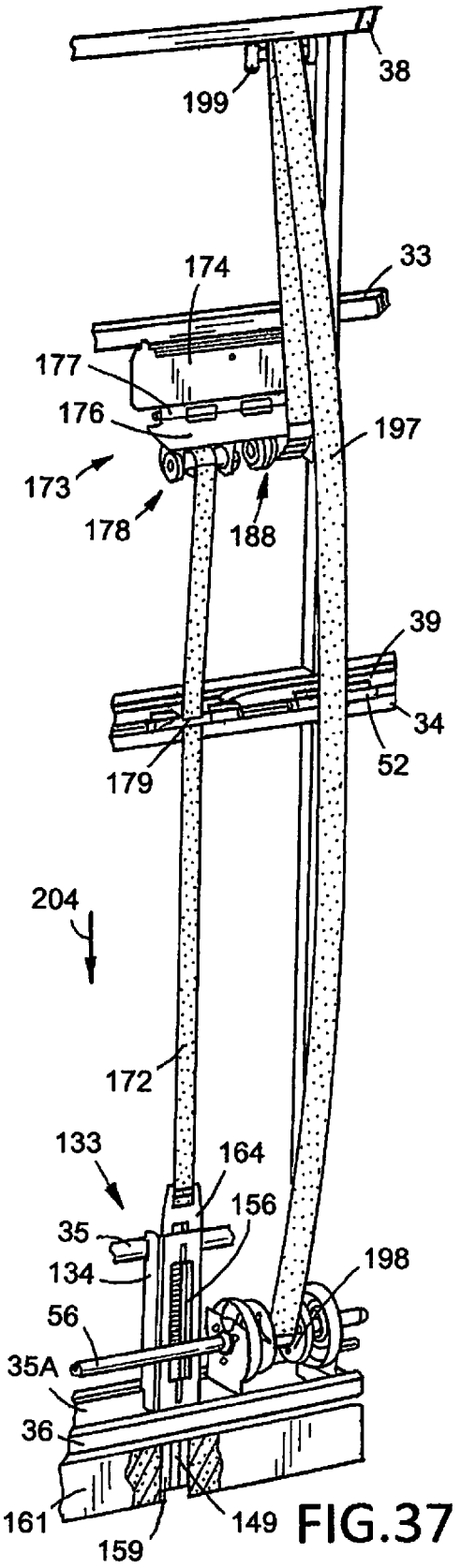
FIG. 37 is a perspective view of the floor anchor assembly with the anchor rod in the floor lock position and the anchor rod lift assembly for the floor anchor assembly.
Figure 38:
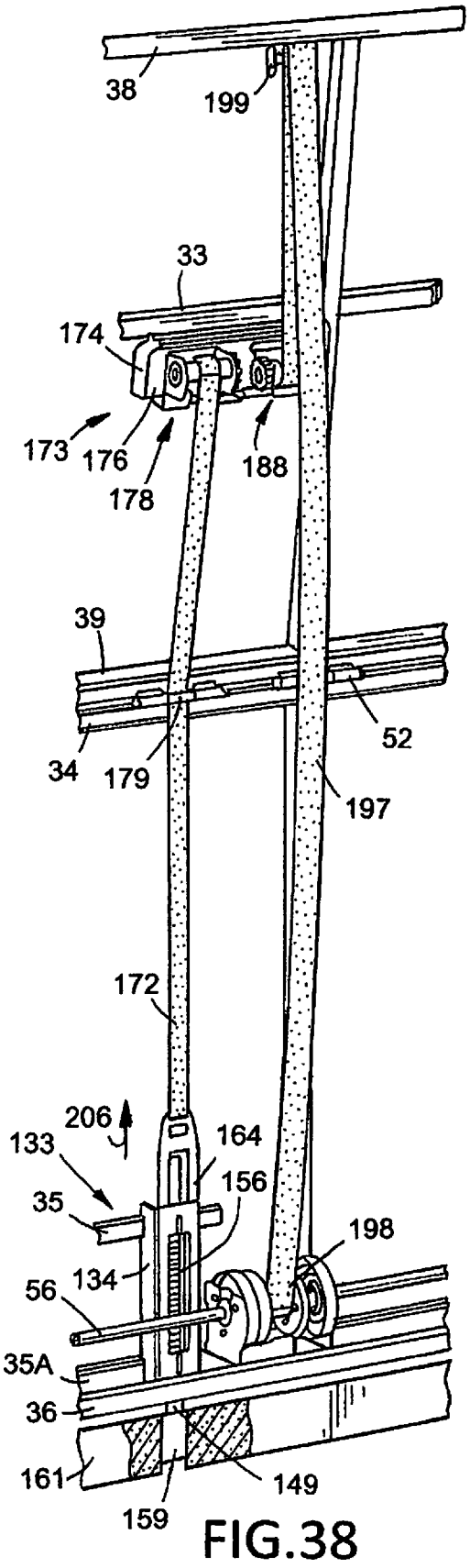
FIG. 38 is a perspective view of the floor anchor assembly with the anchor rod in the floor unanchor or release position and the rod lift assembly for the floor anchor assembly.

As shown in FIGS. 3 and 37, when bi-fold door 22 is in the upright closed position the lower end 149 of rod 148 is located in an anchor position in hole 159 in floor 161. Rod 148 mounted on housing 134 secured to door frame members 35 and 36 inhibits lateral movement of bi-fold door 22 when the lower end 149 of rod is located in hole 159. Rod 148 is moved down shown by arrow 204 to the anchor position by the biasing force of spring 156. Motion transmission mechanism 173 is in a down or first position whereby strap 172 allows rod 148 to be moved by spring 156 to the anchor position. As shown in FIG. 38, drive shaft 56 rotated by the power assembly, motor 82 and power transmission 83, rotates anchor drum 198 to wind strap 197 onto anchor drum 198. Strap 197 as it is wound onto anchor drum moves motion transmission mechanism 173 from the down open position, shown in FIGS. 17 and 37, to the up closed position, shown in FIGS. 35 to 38. The movement of the motion transmission mechanism 173 from the down to up position moves strap 172 upward, shown by arrow 206, thereby moving rod 164 upward out of hole 159 in floor 161 to release anchoring of bi-fold door 22 on floor 161. Motion transmission mechanism 173 in the folded up position function as an anchor member for the upper end of strap 197. Ratchet 178 mounted on motion transmission mechanism 173 adjusts the working length of strap 172 between yoke 164 and motion transmission mechanism 173. Ratchet 188 mounted on motion transmission mechanism 173 adjacent ratchet 178 adjusts the working length of strap 197 between anchor draw 198 and motion transmission mechanism 173.

One embodiment of the bi-fold door lift assembly, door latch assembly and floor anchor assembly has been shown and described. It is understood that changes and modifications in the materials, construction and arrangement of the cooperating assemblies may be made without departing from the invention as expressed in the following claims.

The invention claimed is:

1. A floor anchor assembly for anchoring a door to a floor of a doorway of a building comprising:

a housing, a rod, at least one member secured to the housing for holding the rod and allowing the rod to be moved between a first location for anchoring the door to the floor of a doorway and a second location for releasing the anchoring of the door from the floor of a doorway, a biasing member for biasing the rod to the first location for anchoring the rod to the floor of the doorway, and a lift assembly operatively connected to the rod for moving the rod from the first location to the second location to release the anchoring of the rod from the floor of the doorway, the lift assembly includes a first member movable between a first position and a second position, a first strap connected to the first member and the rod, a second strap connected to the first member, a second member connected to the second strap operable to move the second strap and the first strap and the first member from the first position to the second position whereby the rod moves from the first location to the second location to release the anchoring of the rod from the floor of the doorway, a first ratchet device connected to the first member and to the first strap operable to adjust the working length of the first strap, and a second ratchet device connected to the first member and to the second strap operable to adjust the working length of the second strap.

2. The floor anchor assembly of claim 1 wherein:

the at least one member comprises a pair of spaced members secured to the housing, said spaced members accommodating the rod for movement between the first location and the second location, said rod having a rod portion located between the spaced members, and said biasing member includes a coil spring surrounding the rod portion for biasing the rod to the first location for anchoring the rod to the floor of the doorway.

3. The floor anchor assembly of claim 1 including:

a rotatable shaft, and the second member comprises a drum secured to the rotatable shaft whereby on rotation of the shaft and the drum the second strap is wound onto the drum to move the second strap and the first member from the first position to the second position thereby moving the first strap to release the anchoring of the rod from the floor of the doorway.

4. A floor anchor assembly for anchoring a door to a floor of a doorway comprising:

a housing, a rod, at least one member secured to the housing for holding the rod and allowing the rod to be moved between a first location for anchoring the door to the floor of the doorway and a second location for releasing the anchoring of the door from the floor of the doorway, a biasing member for biasing the rod to the first location for anchoring the rod to the floor of the doorway, a lift assembly operatively connected to the rod for moving the rod from the first location to the second location to release the anchoring of the rod from the floor of the doorway, the lift assembly includes a yoke connected to the rod, a first strap attached to the yoke, a motion transmission mechanism having a member movable between a first position and a second position, said first strap being connected to the member of the motion transmission mechanism, a second strap connected to the member of the motion transmission mechanism, and an apparatus connected to the second strap operable to move the second strap and move the member of the motion transmission mechanism from the first position to the second position of the doorway, the apparatus comprises a drum secured to a rotatable shaft, said second strap being connected to the drum whereby on rotation of the shaft and the drum the second strap is wound onto the drum to move the motion transmission mechanism from the first position to the second position whereby the first strap moves the rod from the first location to the second location to release the anchoring of the rod from the floor of the doorway.

5. The floor anchor assembly of claim 4 including:

a first ratchet device connected to the first strap and member of the motion transmission mechanism operable to adjust the working length of the first strap between the yoke and member of the motion transmission mechanism, and a second ratchet device connected to the second strap and member of the motion transmission mechanism to adjust the working length of the second strap between the apparatus and member of the motion transmission mechanism.

6. A floor anchor assembly for anchoring a door to a floor of a doorway of a structure, the floor having a hole open to the doorway below the door, comprising:

a housing, a rod selectively movable to a first location into the hole in the floor to anchor the door to the floor and to a second location out of the hole in the floor to release the anchor of the door from the floor, at least one member secured to the housing for holding the rod and allowing the rod to be moved between a first location to anchor the door in the hole in the floor of the doorway and a second location for releasing the anchor of the door from the hole in the floor of the doorway, a biasing member for biasing the rod to the first location into the hole in the floor to anchor the rod to the floor of the doorway, a lift assembly operatively connected to the rod for moving the rod from the first location to the second location out of the hole in the floor to release the anchor of the rod from the floor in the doorway, the lift assembly includes a first strap attached to the rod, a motion transmission mechanism having a member movable between a first position and a second position, said first strap being connected to the member of the motion transmission mechanism, a second strap connected to the member of the motion transmission mechanism, an apparatus connected to the second strap operable to move the second strap and move the member of the motion transmission mechanism from the first position to the second position, a rotatable shaft, the apparatus comprises a drum secured to the rotatable shaft, said second strap being connected to the drum whereby on rotation of the shaft and the drum the second strap is wound onto the drum to move the motion transmission mechanism from the first position to the second position whereby the first strap moves the rod out of the hole in the floor to release the anchoring of the rod from the floor of the doorway.

7. The floor anchor assembly of claim 6 including:

a first ratchet device connected to the first strap and member of the motion transmission mechanism operable to adjust the working length of the first strap between the yoke and member of the motion transmission mechanism, and a second ratchet device connected to the second strap and member of the motion transmission mechanism to adjust the working length of the second strap between the apparatus and member of the motion transmission mechanism.

8. A floor anchor assembly for anchoring a door to a floor of a doorway of a building comprising:

a housing, a rod, at least one member secured to the housing for holding the rod and allowing the rod to be moved between a first location for anchoring the door to the floor of a doorway and a second location for releasing the anchoring of the door from the floor of a doorway, a member for retaining the rod in the first location for anchoring the rod to the floor of the doorway, a lift assembly operatively connected to the rod for moving the rod from the first location to the second location to release the anchoring of the rod from the floor of the doorway, the lift assembly includes a first strap attached to the rod, a motion transmission mechanism having a member movable between a first position and a second position, said first strap being connected to the member of the motion transmission mechanism, a second strap connected to the member of the motion transmission, and an apparatus connected to the second strap operable to move the second strap and move the member of the motion transmission mechanism from the first position to the second position, the apparatus comprises a drum secured to a rotatable shaft, said second strap being connected to the drum whereby on rotation of the shaft and the drum the second strap is wound onto the drum to move the motion transmission mechanism from the first position to the second position whereby the first strap moves the rod to release the anchoring of the rod from the floor of the doorway.

9. The floor anchor assembly of claim 8 wherein:

the at least one member comprises a pair of spaced members secured to the housing, said spaced members accommodating the rod for movement between the first position and the second position, said rod having a rod portion located between the spaced members, and said biasing member includes a coil spring surrounding the rod portion for biasing the rod to the first position for anchoring the rod to the floor of the doorway.

10. The floor anchor assembly of claim 8 wherein:

a first ratchet device connected to the first member and to the first strap operable to adjust the working length of the first strap, and a second ratchet device connected to the first member and to the second strap operable to adjust the working length of the second strap.

11. An anchor assembly for anchoring a door to a floor comprising:

a rod, at least one member for holding the rod and allowing the rod to be moved between a first location anchoring the door to the floor and a second location for releasing the anchoring of the door from the floor, a biasing member operatively connected to the rod for biasing the rod to the first location anchoring the rod to the floor, a lift assembly operatively connected to the rod for moving the rod from the first location to the second location to release the anchoring of the rod from the floor, the lift assembly includes a first elongated member connected to the rod, a motion transmission mechanism having a movable member movable between a first position and a second position, a first device connecting the first elongated member to the movable member of the motion transmission mechanism, a second elongated member, a second device connecting the second elongated member to the movable member of the motion transmission mechanism, a rotatable shaft, a drum secured to the rotatable shaft, said second elongated member being connected to the drum whereby on rotation of the shaft and the drum the second elongated member is wound onto the drum moving the movable member from the first position to the second position whereby the first elongated member moves the rod from the first location to the second location to release the anchoring of the rod from the floor.

12. The anchor assembly of claim 11 wherein:

the movable member of the motion transmission mechanism comprises a plate and a hinge pivotally connecting the plate to the door for movement of the plate between the first position and the second position.

13. The anchor assembly of claim 11 wherein:

the first elongated member comprises a first strap, and the second elongated member comprises a second strap.

14. The anchor assembly of claim 11 wherein:

the first device comprises a first ratchet device operable to adjust the working length of the first elongated member and the second device comprises a second ratchet device operable to adjust the working length of the second elongated member.

* * * * *